US006138626A

United States Patent [19]

Speil

[11] Patent Number: 6,138,626

[45] Date of Patent: Oct. 31, 2000

[54] OPERATING LEVER FOR A VALVE TRAIN OF AN INTERNAL COMBUSTION ENGINE

[75] Inventor: Walter Speil, Ingolstadt, Germany

[73] Assignee: Ina Walzlager Schaeffler oHG, Germany

[21] Appl. No.: 09/319,791

[22] PCT Filed: Jul. 10, 1997

[86] PCT No.: PCT/EP97/03664

§ 371 Date: Jun. 8, 1999

§ 102(e) Date: Jun. 8, 1999

[87] PCT Pub. No.: WO98/27318

PCT Pub. Date: Jun. 25, 1998

[30] Foreign Application Priority Data

Dec. 18, 1996 [DE] Germany ..... 196 52 676

[51] Int. Cl.[7] ..... F01L 1/18; F01L 1/16

[52] U.S. Cl. ..... 123/90.39; 123/90.41; 123/90.42; 123/90.43; 74/559

[58] Field of Search ..... 123/90.39, 90.41, 123/90.42, 90.43, 90.44, 90.47; 74/519, 559

[56] References Cited

U.S. PATENT DOCUMENTS

| | | | |
|---|---|---|---|
| 2,385,309 | 9/1945 | Spencer . | |
| 2,448,989 | 9/1948 | Leake . | |
| 5,303,680 | 4/1994 | Nielsen | 123/90.22 |
| 5,535,641 | 7/1996 | Uchida et al. | 74/559 |
| 5,775,280 | 7/1998 | Schmidt et al. | 123/90.41 |
| 5,799,546 | 9/1998 | Pryba | 74/569 |

FOREIGN PATENT DOCUMENTS

| | | |
|---|---|---|
| 8413255 | 7/1984 | Germany . |
| 2115898 | 9/1983 | United Kingdom . |

*Primary Examiner*—Weilun Lo
*Attorney, Agent, or Firm*—Bierman, Muiserlian and Lucas

[57] ABSTRACT

An operating lever for a valve train of an internal combustion engine comprises, on the valve-proximate end, a sliding shoe arranged between itself and an end of a valve stem of a gas exchange valve.

The operating lever is characterized in that it is configured as a chiplessly shaped sheet metal part and comprises in the valve-proximate region (2), a bottom wall (12) which is connected in an upwardly open U-shape to two side walls (5, 6), the bottom wall (12) comprises a downwardly open recess (13) for receiving the sliding shoe (14) which is inseparably retained in the recess (13), and spatial dimensions of the sliding shoe (14) and the recess (13) are matched to each other so that the sliding shoe (14) can freely execute a pivoting movement in the recess (13) caused by a displacement of the valve stem (11).

12 Claims, 1 Drawing Sheet

OPERATING LEVER FOR A VALVE TRAIN OF AN INTERNAL COMBUSTION ENGINE

This application is a 371 of PCT/EP97/03664 filed Jul. 10, 1997.

FIELD OF THE INVENTION

The invention concerns an operating lever for a valve train of an internal combustion engine with a sliding shoe arranged on a valve-proximate end between the operating lever and an end of a valve stem of a gas exchange valve, the sliding shoe being inseparably retained in a downwardly open recess, and spatial dimensions of the sliding shoe and the recess being matched to each other so that the sliding shoe can freely execute a pivoting movement in the recess caused by a displacement of the valve stem.

BACKGROUND OF THE INVENTION

In an operating lever of the pre-cited type known from DE-GM 84 13 255, the sliding shoe arranged in the valve-proximate region between the lever and the gas exchange valve assures that wear in the region of force transmission between the valve operating lever and the valve stem caused by the surface contact between these parts is reduced to a minimum.

A drawback of this lever is that it is a cast structure and is therefore expensive to manufacture and has a large mass. A further drawback is that the fixing of the sliding shoe in the lever is also very complicated. This is effected by a retaining pin which is anchored in the lever and projects into the sliding shoe.

U.S. Pat. No. 5,535,641 discloses a chiplessly shaped finger lever comprising a bottom wall which connects two side walls to each other so that, seen in cross-section, an upwardly open U-shaped lever is formed. However, this lever does not comprise a downwardly open recess and a sliding shoe in the valve-proximate region.

SUMMARY OF THE INVENTION

The object of the invention is therefore to create an operating lever for a valve train of an internal combustion engine which is easy to manufacture, has a small mass and retains the sliding shoe inseparably in a simple manner.

The invention achieves this object by the fact that the operating lever is configured as a chiplessly shaped sheet metal part and comprises in the valve-proximate region, a bottom wall which is connected in an upwardly open U-shape to two side walls, the bottom wall comprises the recess for receiving the sliding shoe, the sliding shoe is retained by two clips which extend beyond the longitudinal extent of the operating lever and are bent over beneath the bottom wall in the valve proximate-region while being spaced from each other at a distance which is smaller than the spatial dimension of the sliding shoe. Besides assuring the retention of the sliding shoe, these clips also serve as a lateral guide for the lever above the valve stem.

The distance between the clips is chosen so that the sliding shoe can be mounted by an elastic widening of the clips. Further, the clips can start from the bottom wall or from the side walls and be rigidly connected to the bottom wall or to the side walls in the bent-over state. This connection can be achieved, for example, by welding and assures an operating lever having a particularly stable configuration.

According to a further feature of the invention, the recess is configured as a curved surface of a circular section, i.e. as a semi-spherical depression. But it is equally possible to configure the recess as a curved surface of a cylindrical section, i.e. as a semi-cylindrical depression.

The recess can be made by a non-chipping shaping procedure such as drawing, stamping or pressing directly out of the bottom wall, or it can be made as a separate component and retained in a corresponding reception of the bottom wall by pressing, soldering or gluing.

If the recess is configured as a curved surface of a cylindrical section, i. e. as a semi-cylindrical depression, it is advantageous, for simplifying the shaping of the semi-cylindrical depression, if the surface to be curved to form the cylindrically shaped portion is separated from the side walls, i.e. if it is connected to the operating lever only at two opposing points in the region of the bottom wall.

The regions of the shaped portion which are separated for manufacturing reasons, i.e. the interrupted connection between the curved surface in the cylindrically shaped portion and the side walls, can be joined to each other again by welding or the like for obtaining more stability under higher loading.

The sliding shoe is made as a pressed, drawn or sintered component and is advantageously provided with a wear-reducing coating, or it is subjected to a heat treatment to increase its hardness. In this way, friction between the sliding shoe and the valve stem is further reduced.

It can be advantageous to equip the sliding shoe with lateral guide cheeks for guiding the lever. Finally, for reducing friction, the reception of the sliding shoe is provided with a bore for the supply of lubricant.

The invention will now be described more closely with reference to the following examples of embodiment.

DETAILED DESCRIPTION OF THE DRAWINGS

Figure 1:
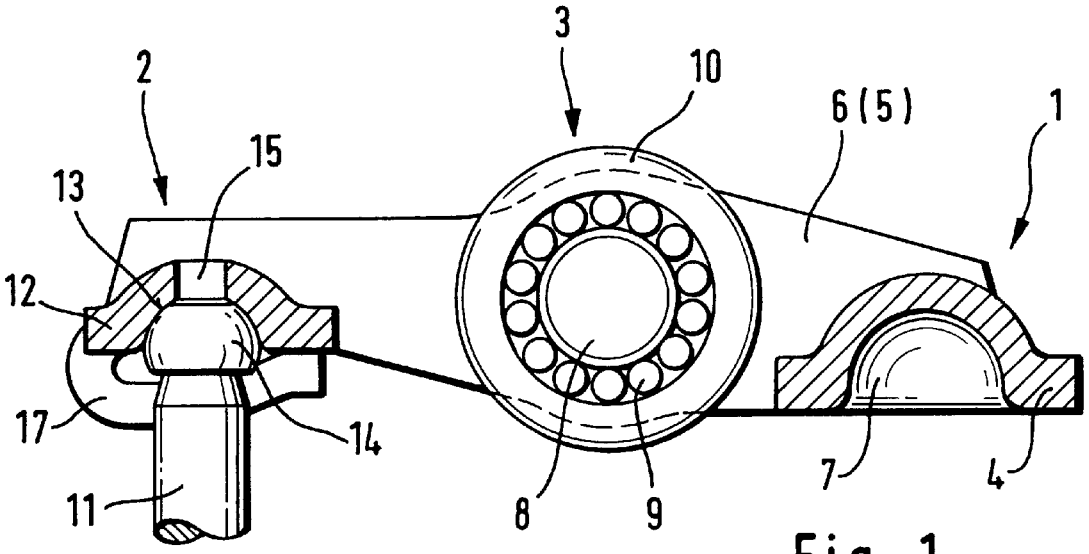
FIG. 1 is a partially sectional side view of a finger lever.

The finger lever shown in FIGS. 1 to 4 is made without chip removal by a shaping procedure out of a sheet metal part and comprises the two end regions 1 and 2 and a central region 3. The end region 1 comprises a bottom wall 4 from which two side walls 5 and 6 extend in an upwardly open U-shape over the entire axial dimension of the finger lever. The bottom wall 4 possesses a downwardly open semi-spherical recess 7 which rests on a support element, not shown.

Figure 2:
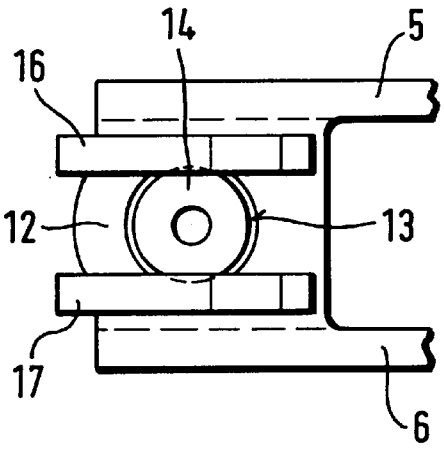
FIGS. 2 and 3 are bottom views of a finger lever in the valve-proximate region.
Figure 3:
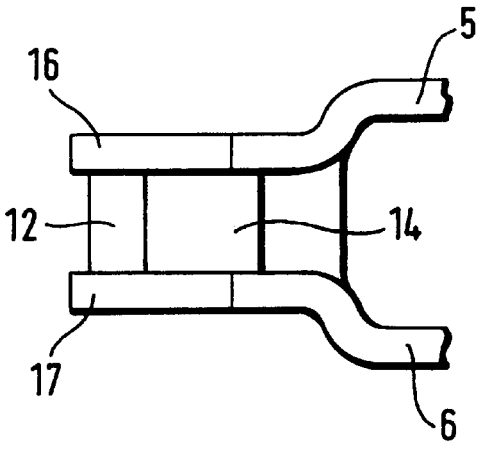

A cam roller 10 contacted by a cam, not shown, is mounted for rotation in the central region 3 via a needle crown ring 9 on an axle 8. In the end region 2, there is arranged a gas exchange valve which opens upon a pivoting motion of the finger lever caused by the cam. The valve-proximate region 2 likewise comprises a bottom wall 12 which is connected in an upwardly open U-shape to the side walls 5 and 6. The bottom wall 12 possesses a downwardly open recess 13 which is made either as a semi-spherical recess as shown in FIG. 2 or as a semi-cylindrical recess as shown in FIG. 3. A sliding shoe 14 is inserted into the recess 13 with its domed end in contact with the recess 13 and its flat surface in sliding contact with the gas exchange valve 11.

As can be seen more particularly in FIG. 2, the size ratios between the recess 13 and the sliding shoe 14 are chosen so that a gap is formed therebetween. This assures that, upon a pivoting motion of the finger lever, the sliding shoe 14 can change its position within the recess 13 without obstruction. To reduce friction, the recess 13 is provided with a bore 15 for the supply of lubricant.

Figure 4:
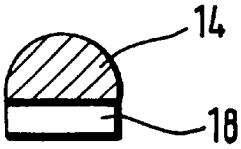
FIG. 4 shows a sliding shoe.

As can be seen further in FIGS. 1 to 3, the sliding shoe is retained in the recess 13 by two clips 16 and 17 which are bent over beneath the bottom wall 12 in the valve-proximate region 2. These clips 16 and 17 start either from the bottom wall 12 as shown in FIG. 2, or from the side walls 5 and 6 as shown in FIG. 3 and provide a lateral guidance for the lever. FIG. 1 also shows that the clips 5 and 6 bear only against a part of the bottom wall 12 so that in this respect, too, a free movement of the sliding shoe 14 within the recess 13 is assured. Finally, FIG. 4 shows a sliding shoe 14 which is provided with lateral guide cheeks 18 for guiding the gas exchange valve 11.

The invention, however, is not restricted to the described embodiment of a finger lever. In place of the bottom walls 4 and 12, it is also possible to provide top walls from which the side walls 5 and 6 extend downwards to give the finger lever the configuration of a downwardly open U-shape. Further, a reverse arrangement of the ball and the semi-spherical recess is also possible, that is to say, a dome-shaped stamped projection can be provided on the finger lever to cooperate with a sliding shoe having a semi-spherical concave countersurface.

What is claimed is:

1. An operating lever for a valve train of an internal combustion engine with a sliding shoe (14) arranged on a valve-proximate end between the operating lever and an end of a valve stem (11) of a gas exchange valve (11), the sliding shoe (14) being inseparably retained in a downwardly open recess (13), and spatial dimensions of the sliding shoe (14) and the recess (13) being matched to each other so that the sliding shoe (14) can freely execute a pivoting movement in the recess (13) caused by a displacement of the valve stem (11), wherein the operating lever is configured as a chip-lessly shaped sheet metal part and comprises in the valve-proximate region (2), a bottom wall (12) which is connected in an upwardly open U-shape to two side walls (5, 6), the bottom wall comprises the recess (13) for receiving the sliding shoe (14), and the sliding shoe (14) is retained by two clips (16, 17) which extend beyond the longitudinal extent of the operating lever and are bent over beneath the bottom wall (12) in the valve-proximate region (2) while being spaced from each other at a distance which is smaller than the spatial dimension of the sliding shoe (14).

2. An operating lever according to claim 1, wherein that the distance between the clips (16, 17) is chosen so that the sliding shoe (14) can be mounted by an elastic widening of the clips (16, 17).

3. An operating lever according to claim 1, wherein the clips (16,17) start from the bottom wall (12) or from the side walls (5,6) and are rigidly connected respectively to the bottom wall (12) or to the side walls (5,6) in the bent-over state.

4. An operating lever according to claim 1, wherein the recess (13) is configured as a curved surface of a circular section.

5. An operating lever according to claim 1, wherein the recess (13) is configured as a curved surface of a cylindrical section.

6. An operating lever according to claim 1, wherein that the recess (13) is made by a non-chipping shaping procedure of drawing, stamping or pressing directly out of the bottom wall (12) or as a separate component which is retained in a corresponding reception of the bottom wall (12) by pressing, soldering or gluing.

7. An operating lever according to claim 1 wherein the recess (13) is configured as a semi-spherical depression.

8. An operating lever according to claim 5 wherein the recess (13) is configured as a semi-cylindrical depression.

9. An operating lever according to claim 1, wherein that the sliding shoe (14) is made as a pressed, drawn or sintered component.

10. An operating lever according to claim 1, wherein that the sliding shoe (14) is provided with a wear-reducing coating, or subjected to a heat treatment.

11. An operating lever according to claim 1 wherein that the sliding shoe (14) comprises lateral guide cheeks (18).

12. An operating lever according to claim 1, wherein that the recess (13) is provided with a lubrication bore (15).

* * * * *